US008752671B1

(12) United States Patent
Holman

(10) Patent No.: US 8,752,671 B1
(45) Date of Patent: Jun. 17, 2014

(54) PORTABLE COLLAPSIBLE HORSE-MOUNTING DEVICE

(71) Applicant: Diane Henderson Holman, Crockett, TX (US)

(72) Inventor: Diane Henderson Holman, Crockett, TX (US)

( * ) Notice: Subject to any disclaimer, the term of this patent is extended or adjusted under 35 U.S.C. 154(b) by 0 days.

(21) Appl. No.: 13/861,023

(22) Filed: Apr. 11, 2013

(51) Int. Cl.
*E06C 1/00* (2006.01)

(52) U.S. Cl.
USPC ..... 182/189; 182/180.2; 182/107; 182/200

(58) Field of Classification Search
USPC ..... 182/107, 187, 189, 180.2, 179.1, 100, 182/111, 108, 156, 194, 200
See application file for complete search history.

(56) References Cited

U.S. PATENT DOCUMENTS

| | | | | | |
|---|---|---|---|---|---|
| 238,067 | A * | 2/1881 | Teed | 182/180.3 |
| 2,311,352 | A * | 2/1943 | Seiler | 182/136 |
| 3,019,851 | A * | 2/1962 | Doss | 182/111 |
| 3,327,810 | A * | 6/1967 | Johnson et al. | 182/17 |
| 4,202,428 | A * | 5/1980 | Hickman | 182/22 |
| 4,589,523 | A * | 5/1986 | Olson et al. | 182/234 |
| 5,347,797 | A | 9/1994 | Seal et al. | |
| 5,661,957 | A | 9/1997 | Daly | |
| D394,715 | S * | 5/1998 | Pearson | D25/64 |
| 5,860,490 | A * | 1/1999 | Petti et al. | 182/134 |
| 6,026,633 | A | 2/2000 | Burke, Jr. | |
| 6,282,872 | B1 | 9/2001 | Schulte | |
| 6,688,088 | B1 | 2/2004 | Aweeka, Jr. | |
| 6,830,128 | B2 * | 12/2004 | Burgeson | 182/116 |
| 7,051,497 | B2 | 5/2006 | Peterson et al. | |
| 7,163,084 | B1 * | 1/2007 | Blehm | 182/172 |
| 7,263,817 | B1 | 9/2007 | Smith | |
| 7,380,390 | B1 | 6/2008 | Brassfield | |
| 7,386,973 | B2 | 6/2008 | Madill, Jr. | |
| 7,574,849 | B2 | 8/2009 | Gottlieb | |

OTHER PUBLICATIONS

Definition of "pad" provided in Action The American Heritage® Dictionary of the English Language, Fourth Edition copyright © 2000 by Houghton Mifflin Company. Updated in 2009. Published by Houghton Mifflin Company. All rights reserved.*

* cited by examiner

*Primary Examiner* — Katherine Mitchell
*Assistant Examiner* — Daniel Cahn
(74) *Attorney, Agent, or Firm* — Mary J. Gaskin

(57) ABSTRACT

A portable, collapsible, free-standing device for use by a rider to access the saddle stirrup when mounting a horse. The device has a center support pole with a handle on one end and a base on the other. Two folding steps are each pivotally mounted to spaced-apart brackets attached to the pole, to assist the rider to reach the stirrup. Several folding legs are mounted to a collar attached to the center pole in order to stabilize the device. The legs can be configured with extensions so that the device can be leveled on uneven terrain. Pivoting foot pads can be attached onto the ends of the legs. A rope is attached to the handle so that the device can be pulled up after the rider has mounted the horse, whereupon the device can be folded and collapsed for storage on the horse.

5 Claims, 5 Drawing Sheets

PORTABLE COLLAPSIBLE HORSE-MOUNTING DEVICE

FIELD OF THE INVENTION

The present invention relates to a portable, collapsible device that can support a person when mounting a horse, for example.

BACKGROUND OF THE INVENTION

In terms of safety, a rider is most vulnerable when mounting and dismounting a horse. Large mounting blocks are available that provide a rider with enough elevation to mount a horse; however, these blocks are heavy, not collapsible, and not portable. Frequently, a rider may find himself in a location with no obvious structure on which to elevate himself, such as a mounting block, a fence, an overturned bucket, or a natural object, such as a large rock, a tree stump, or a dirt bank, in order to mount or re-mount the horse. Some type of assistance is frequently necessary in order to elevate the rider so he can be mounted into the saddle. Often, a rider is not in the company of another person who can help him mount the horse.

Stirrups, one attached to each side of a saddle, provide a foothold for a rider and can aid him in mounting a horse. However, often stirrups must be shortened for the saddle, as in the case of a shorter rider, so that, when seated atop the horse in the saddle, the rider's feet are able to reach the stirrups. As a result, such stirrups are even higher from the ground, making it more difficult for a short rider, a child, a physically-limited rider, or an older rider to reach the stirrups from the ground. Even if a stirrup can be lowered enough so that a rider can reach the stirrup with one foot while standing on the ground, it would take superior physical ability for a rider to hoist his weight up and over the back of the horse from that even lower stirrup position.

Presently, devices for mounting horses are of two types: (1) devices for attachment to one of the stirrups on a horse's saddle; and (2) devices for attachment to the saddle itself. Numerous patents have issued for the first type of devices, which essentially lengthen the stirrup in some manner in order to extend it lower to the ground for the rider. Such patents include U.S. Pat. No. 5,661,957; U.S. Pat. No. 6,026,633; U.S. Pat. No. 6,282,872; U.S. Pat. No. 6,688,088; U.S. Pat. No. 7,263,817; U.S. Pat. No. 7,380,390; and U.S. Pat. No. 7,574,349. Often such an "extended" stirrup is still not long enough to allow a rider to reach it from the ground, and, even if it is accessible, the rider will be suspended alongside the horse in an unsafe manner until he or she can climb into the saddle stirrup and swing his or her other leg over the horse.

Examples of the second type of device are shown in U.S. Pat. No. 5,347,797 (which shows a mounting stirrup on a strap with a loop that can be attached to the horn of the saddle); U.S. Pat. No. 7,051,497 (which shows a rope ladder that is attached to the saddle); and U.S. Pat. No. 7,386,973 (which shows a retractable stirrup that is attached to the saddle). As with the first type of device, when mounting a horse, a rider will spend time hanging alongside the horse in an unsafe position, with the weight of the rider hanging on one of its sides; the horse may experience physical stress and unbalance. If the horse moves unexpectedly, the rider can be in a precarious situation.

Finally, after a rider mounts the horse, some of the presently available inventions are designed to be left hanging alongside the animal's body, in an unwieldy, unsafe manner.

There continues to be a need for a collapsible, portable device that allows a rider to safely mount and re-mount a horse, even in an isolated location.

SUMMARY OF THE INVENTION

The present invention provides a rider with a portable, collapsible, free-standing device that can be positioned on the ground next to a horse and then used by a rider to access the saddle stirrup and mount the horse.

The device can be used by all types of riders, regardless of their size, age, or physical abilities. It allows a rider to mount and dismount a horse with confidence, wherever the horse is located. The device does not depend on the presence of an extra stirrup, step, or rung attached to the horse's saddle. Because the device is collapsible, it can be stored on the horse after the rider is in the saddle.

Because the device is designed to be freestanding on the ground next to the horse, it provides the same type of elevation as if a rider were mounting the horse from a stationary mounting block. The rider steps onto the device until his foot reaches the stirrup, and he then mounts the horse in typical fashion. After the rider is in the saddle, he or she can use the rope or tether that is attached to the device to pull it upwards onto the horse. The rider then collapses the device and stores it on the horse, either behind the saddle like a bedroll or alongside the shoulder of the horse like a holster or scabbard.

The device is useful for the events of trail riding, arena riding, showing, rodeo, racing, and any other situation in which a rider needs to mount his horse.

The present device is constructed with a center support pole, legs, steps, and a handle with a rope or tether attached. Affixed to the lower end of the vertical support pole are legs, which fold down when deployed and fold up for storage. Above the legs, two folding steps are attached to the support pole, angled at least 90° from each other, the upper step spaced approximately ten inches above the lower step, and the lower step spaced approximately ten inches above the ground when the device is set up for use in mounting a horse. A handle formed at the upper end of the support pole is used to steady the rider as he positions himself on the device, and also to pick up the device. A rope or tether attached to the handle is used by the rider to pull the device up and onto the horse for storage.

In order to use the device, a rider folds the legs and both of the steps downward and then positions the device next to the horse. Holding the tether in one hand (or having looped it around the horn of the saddle), he then climbs the steps in order to access the stirrup of the saddle, which he uses to climb into the saddle. He places both feet in their respective stirrups, and he uses the tether to pull the device upwards, collapsing it so that it can be quickly stored on the back of the saddle or at the horse's shoulder. An optional lightweight storage case can be used to hold the device between uses.

It is an object of the present invention to provide a lightweight, portable, collapsible, free-standing device that can be used by a rider to safely and easily mount a horse.

Another object of the present invention is to provide a device that can be stored on the horse after it is used for mounting, so that a rider can use it to re-mount the horse at any location and in any terrain.

Yet another object of the present invention is to provide a lightweight mounting device that is simple to handle and to deploy, yet is stable on any type of terrain and sturdy enough to hold up to 250 pounds of weight.

Other objects and advantages of the present invention will become apparent from a consideration of the drawings and description, infra.

DESCRIPTION OF PREFERRED EMBODIMENT

Figure 1:
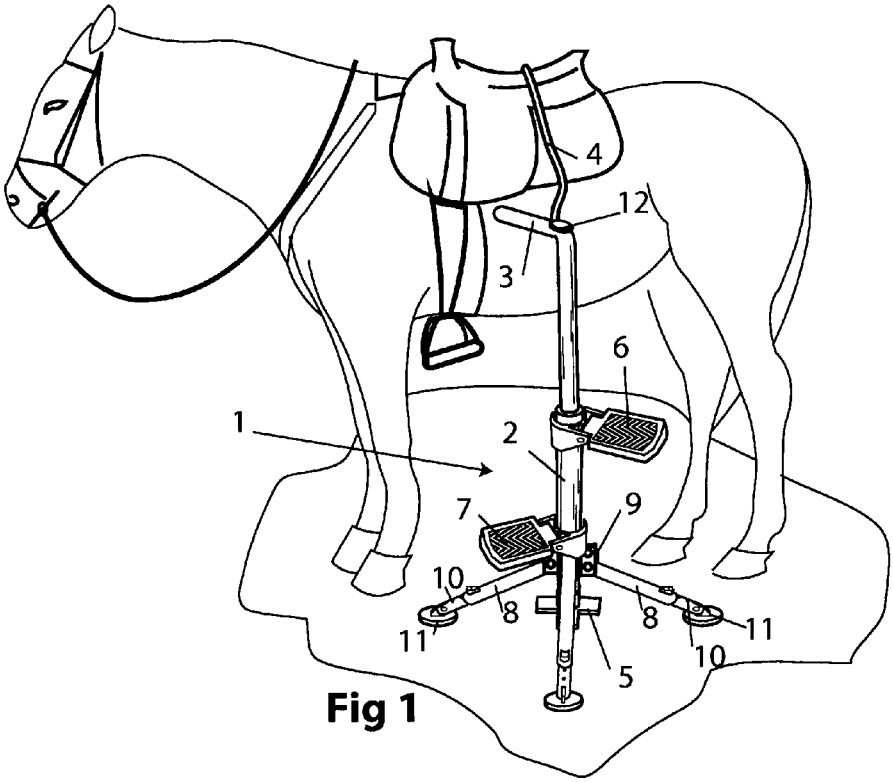
FIG. 1 is a perspective view of the device of the present invention, set up next to a horse (stylized), for use by a rider to mount the horse.

As shown in FIG. 1, the horse-mounting device 1 of the present invention comprises a center pole 2 with a handle 3, to which a rope 4 is attached. The center pole 1 is supported at its bottom end by a base 5. An upper step 6 and a lower step 7 are pivotally attached to the center pole 1. The upper step 6 and the lower step 7 are angled approximately 90° to 120° apart. The upper ends of the plurality of legs 8 are pivotally affixed to a collar 9, which is mounted onto the center pole 1, under the lower step 7. A leg extension 10 can be inserted into the lower end of each leg 8 so that the user can lengthen the legs 8, if needed. A foot 11 is pivotally mounted onto the end of each leg extension 10 in order to stabilize the device 1 on uneven terrain. The entire device 1 is constructed from a rigid, lightweight material, which can be a metal such as aluminum, or a carbon fiber composite, or a combination of such materials, the material being strong enough to ensure the device 1 can support at least 250 pounds of weight, and one which is sturdy enough to withstand the folding and unfolding process. Ideally, the total weight of the device 1 is approximately five pounds. The device 1 is fashioned to allow it to be folded up, or collapsed, into a cylindrical shape for storage. Ideally, when collapsed, the device 1 will occupy a space of approximately 6 inches by 6 inches by 18 inches. After it is collapsed, the device 1 can be packed into a soft or hard case for storage. When the device 1 is needed, it can be easily unfolded for set-up at any location. The lower step 7 of the device 1 allows a rider to step up approximately 10 inches off the ground, and the upper step 6 allows a rider to step up another ten inches off the ground in order to access the stirrup of the horse's saddle. A release pin 12 on the handle 3 allows its height to be adjusted.

Figure 2:
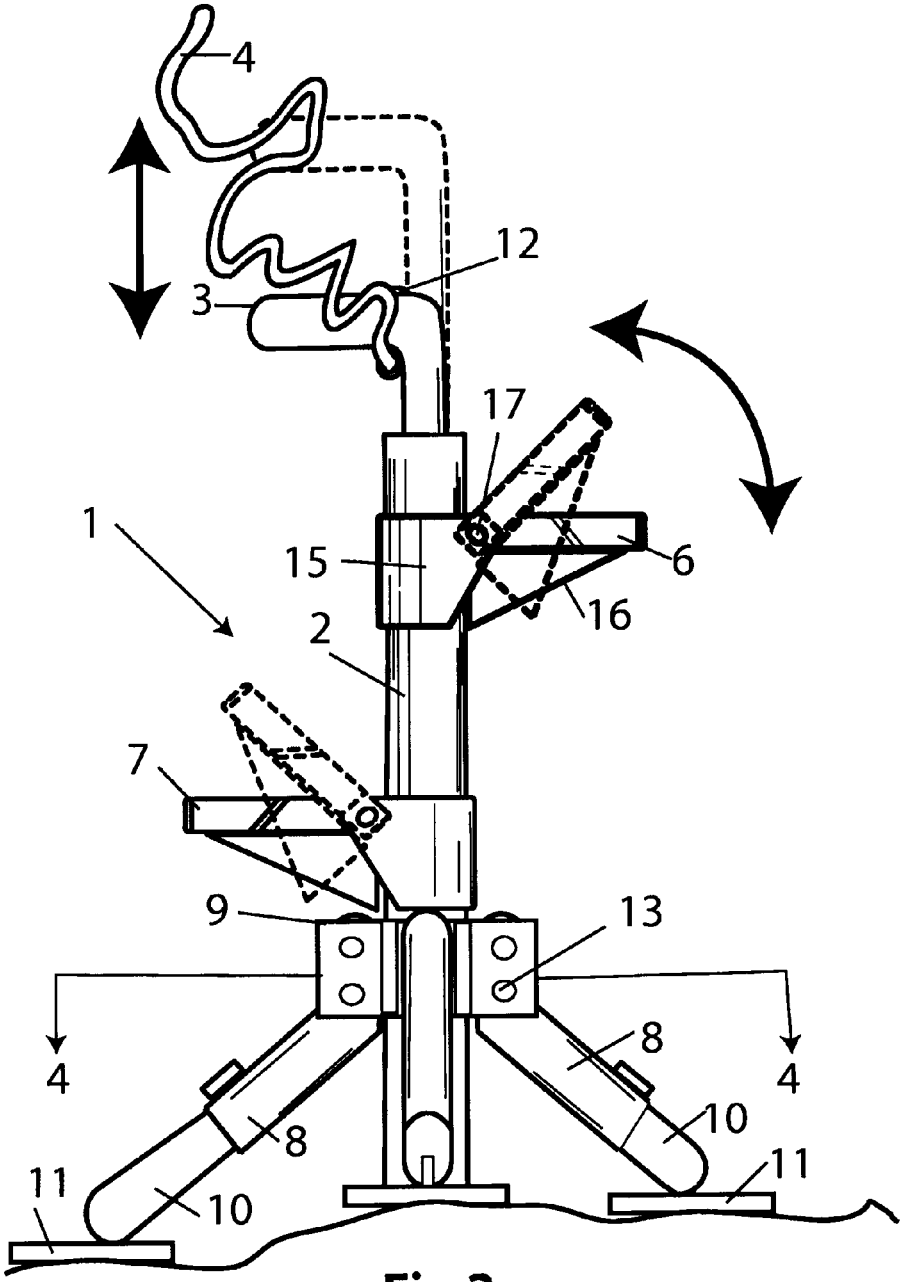
FIG. 2 is a side plan view of the present invention set up on uneven terrain, with the storage positions of the handle and one of the steps shown in dotted lines.

As shown in FIG. 2, the horse-mounting device 1 of the present invention can be set up on uneven terrain. The leg extensions 10 on each of the legs 8 can be extended to differing lengths in order to level the device 1. The feet 11 prevent the device 1 from sinking into soft ground. The upper ends of the legs 8 have been pivotally affixed to the collar 9 with pivot pins 13, which lock the legs 8 when they are deployed and unlock the legs 8 when the device 1 is collapsed for storage. The upper step 6 is mounted onto a step bracket 15, which is affixed to the center pole 2. A step support 16 under the step 6 is configured to keep the step 6 level when the device 1 is set up. A step pivot pin 17 allows the step 6 to be pivoted upwards when the device 1 is collapsed for storage. The handle 3 has release pin 12, which can been pressed to allow the handle 3 to be telescoped upward for use, or pushed downward into the center pole 3 for storage. The rope 4 attached to the handle 3 is used to pull the collapsed device 1 upwards onto the horse after a rider has mounted.

Figure 3:
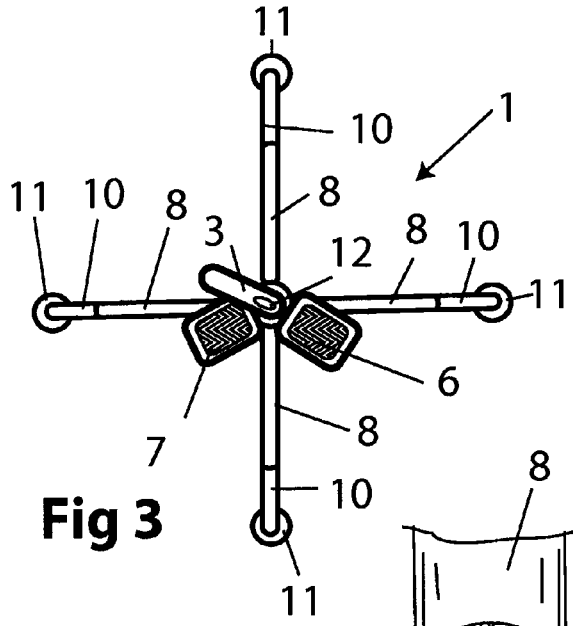
FIG. 3 is a top plan view of the present invention.

FIG. 3 shows a top plan view of the device 1 with a handle 3 having a release pin 12, after it has been set up. The legs 8 with extensions 10 and feet 11 have been deployed, and the upper step 6 and the lower step 7 have been folded down, angled approximately 120° apart, so that a rider may step onto the device 1.

Figure 4:
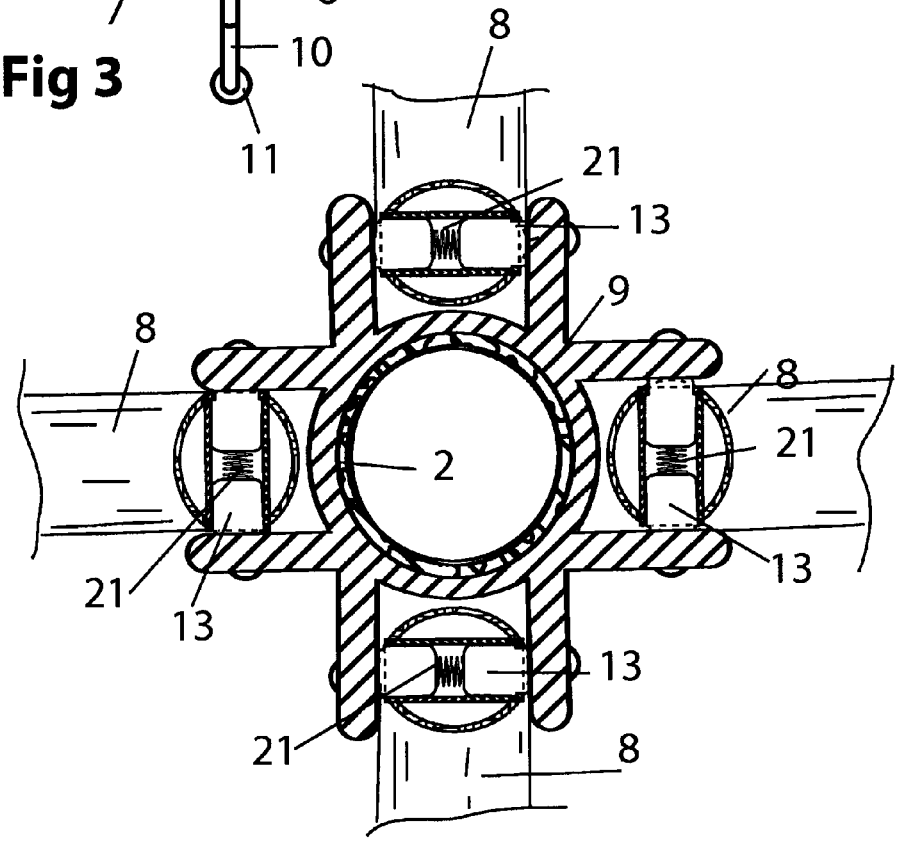
FIG. 4 is a sectional view of the mechanism holding the legs of the present invention, taken along line 4-4 of FIG. 2.

The sectional view of FIG. 4 shows the locking and unlocking mechanism for each of the four legs 8. The upper ends of the legs 8 are affixed to the collar 9 with pivot pins 13. The collar 9 is mounted onto the center pole 2. A spring 21 in the pivot pin 13 expands and compresses as the legs 8 are unlocked and locked.

Figure 5:
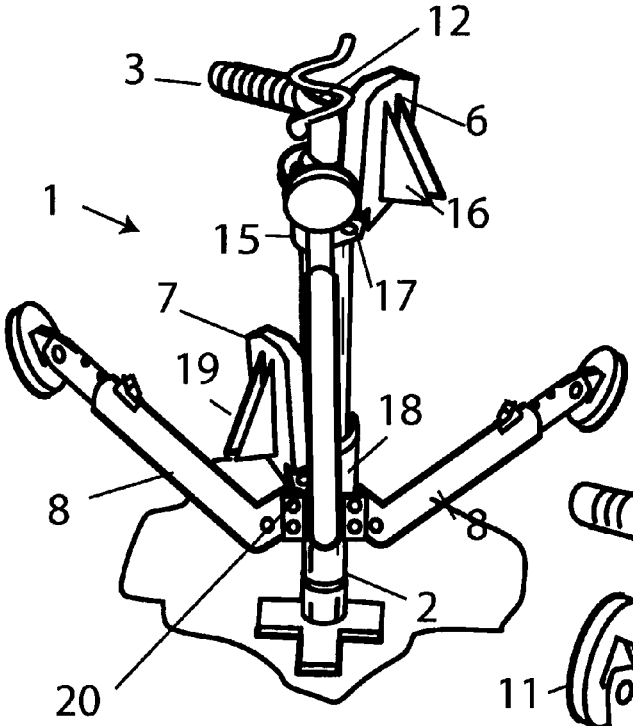
FIG. 5 is a perspective view of the present invention, with the steps in a folded position and the legs partially folded up.

FIG. 5 shows the horse-mounting device 1 as it is collapsed for storage. The upper step 6, attached to step bracket 15 with pivot pin 17 and having step support 16, has been folded up along center pole 2, and the lower step 7, attached to step bracket 18 with pivot pin 20 and having step support 19, has also been folded up along center pole 2, and the handle 3 has been unlocked with release pin 12 and inserted into the center pole 2. The legs 8 are then folded upward.

Figure 6:
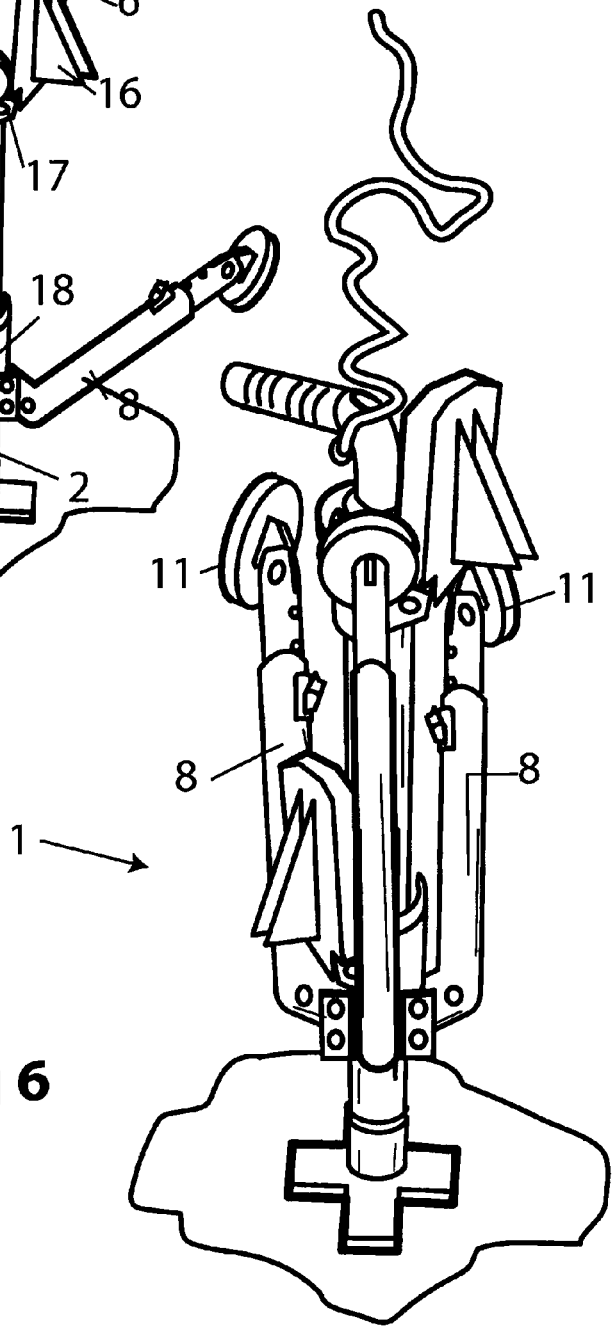
FIG. 6 is a perspective view of the present invention with the steps folded and the legs completely folded up for storage.

As shown the FIG. 6, the horse-mounting device 1 has been collapsed and is ready for storage. The legs 8 have been folded completely upward, and the feet 11 have been pivoted to align with the legs 8.

Details regarding the leg extensions 10 and the feet 11 are shown in FIG. 7 through FIG. 10.

Figure 7:
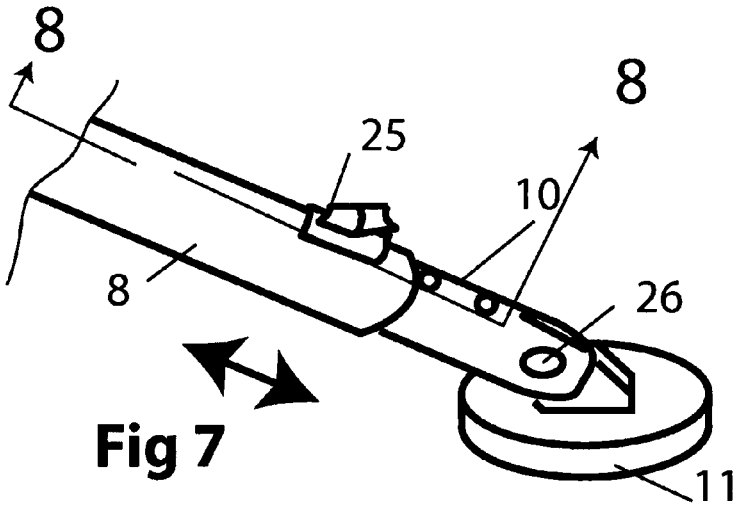
FIG. 7 is a side view of one of the legs of the present invention.

In FIG. 7, the leg 8 has an engaging pin 25 for latching and unlatching the leg extension 10, in order to allow the leg 8 to be lengthened. A foot 11 is pivotally mounted onto the leg extension 1 with pivot pin 26.

Figure 8:
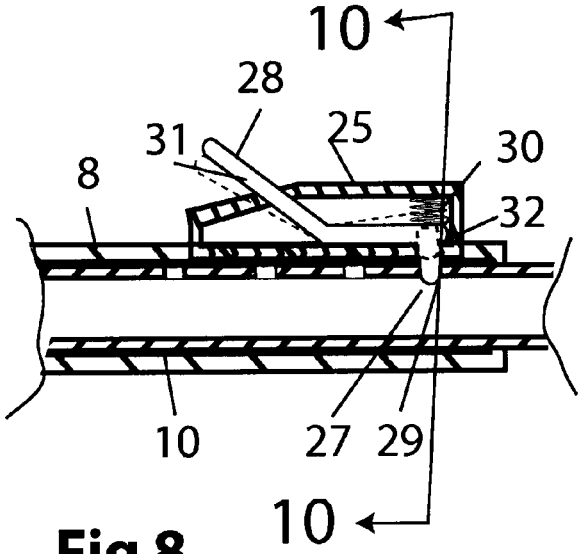
FIG. 8 is a section view of the leg shown in FIG. 7 taken along line 8-8 of FIG. 7.

FIG. 8 shows a sectional view of the engaging pin 25 mounted onto the end of the leg 8. The pin 27 of the latch 28 of the engaging pin 25 can be pressed into an opening 29 on the end of the leg 8, releasing the spring 30 in order to hold the leg extension 10 in place. When the latch handle 31 is pushed down, the head 32 of the latch 28 pushes against the spring 30, compressing it and allowing the leg extension 10 to be moved.

Figure 9:
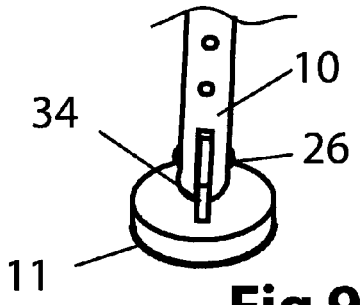
FIG. 9 is an enlarged view of one of the pivoting feet attached to a leg on the present invention.

As shown in FIG. 9, the foot 11 is attached to the lower end of the leg extension 10 with mounting bracket 34.

Figure 10:
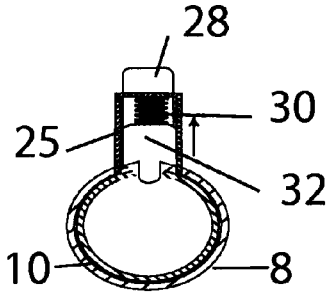
FIG. 10 is a sectional view of the foot shown in FIG. 9 taken along line 10-10 of FIG. 9.

The sectional view of FIG. 10 shows the spring 35 in the pivot pin 26, which allows the foot 11 to pivot about an axis, in order to allow the horse-mounting device 1 to be stabilized on uneven terrain.

I claim:

1. A portable, freestanding device for use in mounting a horse, the device comprising:

a center pole having a first end and a second end;

a handle formed on the first end of the center pole;

a rope attached to the handle;

a base support affixed to the second end of the center pole;

an upper step bracket mounted onto the center pole at a position between the first end of the center pole and the second end of the center pole;

an upper step pivotally mounted onto the first upper step bracket;

a lower step bracket mounted onto the center pole at a position below the upper step bracket;

a lower step pivotally mounted onto the lower step bracket;

a collar mounted onto the center pole below the lower step bracket;

at least four legs, each one of the legs having a first end and a second end, the first end of the legs respectively being pivotally mounted onto the collar;

locking means for releasably locking each of the legs;

Wherein each of the second ends of each of the legs has an opening, the device further comprising:

a plurality of leg extensions, each of the leg extensions having a first end and a second end, each of the first ends of the leg extensions respectively being inserted into the opening in the second end of the legs respectively;

latching means for releasably locking each of the leg extensions into an extended position.

2. The device of claim 1 which further comprises:

a plurality of feet, each of the feet pivotally mounted onto the second ends of each of the leg extensions respectively.

3. The device of claim 1 which further comprises:

a plurality of feet, each of the feet pivotally mounted onto the second ends of each of the leg extensions respectively.

4. The device of claim 1, wherein the device is made from a material selected from the group consisting of carbon fiber composite and aluminum.

5. The device of claim 1, wherein the upper step and the lower step are angled approximately 90° to 120° apart.

* * * * *